United States Patent [19]

Tennant

[11] 3,958,578

[45] May 25, 1976

[54] ANTI-PRONATING DEVICE

[76] Inventor: Ross A. Tennant, 10 N. Main St., Newmarket, N.H. 03857

[22] Filed: Feb. 27, 1975

[21] Appl. No.: 553,686

Related U.S. Application Data

[63] Continuation-in-part of Ser. No. 165,666, July 23, 1971, abandoned.

[52] U.S. Cl. ..... 128/585; 128/80 R; 272/96

[51] Int. Cl.[2] ..... A61F 5/14

[58] Field of Search ..... 272/57 D, 80; 128/583, 128/584, 585, 610, 80 R, 80 J; 36/2.5 A, 2.5 Y

[56] References Cited

UNITED STATES PATENTS

| | | | |
|---|---|---|---|
| 1,637,565 | 8/1927 | Gordon | 272/57 D |
| 1,958,097 | 5/1934 | Shaw | 128/585 |
| 2,114,790 | 4/1938 | Venables | 272/57 D |
| 2,160,238 | 5/1939 | Turner | 128/584 |
| 2,390,416 | 12/1945 | Bettmann | 128/585 |
| 2,518,649 | 8/1950 | Tydings et al. | 128/585 |
| 2,616,190 | 11/1952 | Darby | 128/585 |
| 2,847,769 | 8/1958 | Schlesinger | 128/585 |
| 2,884,717 | 5/1959 | Goldberg | 128/610 |
| 3,463,165 | 8/1969 | Goodman | 128/583 |

*Primary Examiner*—Richard C. Pinkham
*Assistant Examiner*—Harry G. Strappello
*Attorney, Agent, or Firm*—C. Yardley Chittick

[57] ABSTRACT

The invention is an article of manufacture in the form of specially shaped weight bearing units which are placed under the outer part of the user's feet. The units may be removably or permanently secured to the user's shoes. Through the use of the invention, the foot muscles can be developed and strengthened to overcome so-called flat feet caused by fallen arches.

8 Claims, 9 Drawing Figures

ANTI-PRONATING DEVICE

RELATED APPLICATIONS

This application if a continuation-in-part of the application of Ross A. Tennant, Ser. No. 165,666 filed July 23, 1971 for Anti-pronating Device, now abandoned.

FIELD OF THE INVENTION

This invention relates to an exercising or training device and more particularly relates to a foot-attached exercising device which is useful in overcoming the problem relating to pronation, i.e., weak arches in persons of all ages.

Pronation is generally recognized as a condition of the foot whereby the muscles which normally maintain the arch of the foot in its typically raised position do not satisfactorily perform this function, thus resulting in a so-called weak or flat-footed condition. Most prior art corrective treatment of pronation is directed to arch padding and arch supports of one form or another in the attempt to hold the arch in a raised position on the theory of strengthening muscles ordinarily involved in the movement of inversion. By far the most prevalent of the prior art exercises which is prescribed is picking up marbles, or other similar objects, with the toes. These exercises, however, do little or nothing to correct the pronation condition. Other prior art attempts at correcting pronation include placing wedges at selected locations on the soles of the shoes.

SUMMARY OF THE INVENTION

The anti-pronation device disclosed herein is to be regarded as an exerciser to be worn as a removable attachment on the underside of each of the shoes of the user, as an attachment in the nature of a sandal to be secured to the foot or as units to be secured directly to the soles of the user's shoes. This is a training device and should be worn during designated training periods only. Thus my invention improves upon the prior art deficiencies by providing an anti-pronation device in the nature of a clog having an off-centered longitudinally extending relatively thick bar portion beneath the outer half of the user's foot. This clog may be attached to the shoe of a wearer or, alternatively, may be worn directly on the foot. Because of the off-centered location of the longitudinal bar, the wearer's foot has a tendency to tilt or bend inwardly into an acknowledged position of pronation or eversion. In an effort, however, to raise the inside of the clog to horizontal, the wearer must utilize the muscles involved in the elevation of his inner arch to force the weight to the outer weight bearing area of the foot, thus exercising and training the very muscles used in the movement of inversion.

It is accordingly an object of this invention to provide an exercising and training device which can be attached directly to a user's foot or can be permanently or removably attached to the under side of the user's shoe.

Another object of this invention is to provide a foot attached or shoe attached device which when worn in a prescribed manner will train inverter muscles which have the ability to invert, but have not been functioning in this capacity, so as to correct a weak arch condition.

DETAILED DESCRIPTIONS OF THE INVENTION

The theory of principle of the herein disclosed invention is based on muscle education or re-education, i.e., training the adult or child to use his muscles to maintain the foot in a normal position. Normal weight bearing on the bottom of a foot does not occur from the heel to the head of the first metatarsal and head of the fifth metatarsal as is often interpreted but rather from the heel, along the outer border of the foot and across the ball, i.e., the calcaneus, the cuboid, base of the fifth metatarsal and the under portion of the metatarsal heads. However, in pronation or eversion, (the flat-foot condition), the weight bearing occurs along a path from the heel to the area of the first and second metatarsal heads with little or no weight carried along the normal outer border weight bearing area of the foot.

Inversion or supination is the act of raising the inner arch and forcing the weight bearing through its normal course. Muscles involved in this are called inverters and those primarily involved are specifically the tibialis posterior with accessory aid from flexor digitorum longus, flexor hallucis longus, and tibialis anterior. With the inner longitudinal arch inverted, the peroneous longus has a tightening effect on the tarsal region and in conjunction with other lateral muscles is important to maintaining a persons balance.

The tibialis posterior is by far the most effective inverter with the others being accessories in this movement. In all cases, inversion is only one of two or three movements in which each muscle is involved.

A person pronating, (i.e., with flat feet), knows only one way to stand and walk, and that is with the inner arch in a relaxed and flattened position, usually to the limits of the outer rotation or eversion. The prior art teaches the use of arch pads attempting through the application of pressure on the arch to prevent it from lowering — but the person still knows only one way to stand and, consequently, endures the pressure until he becomes accustomed to it. To correct the flat-foot condition, inversion is desired in order that the weight of the person may be carried along and through the normal weight bearing areas along the outer margin of the foot, thus influencing the alignment of the leg and thigh which has a tendency to rotate inward with the pronated foot. Though the muscles necessary to accomplish this inversion are present, since they have never been utilized to perform their function as inverters, there should preferably be a training period, first to teach the person how to raise his arch with his own muscular effort and, secondly, to walk while still maintaining the arch in its muscularly raised position.

Figure 5:
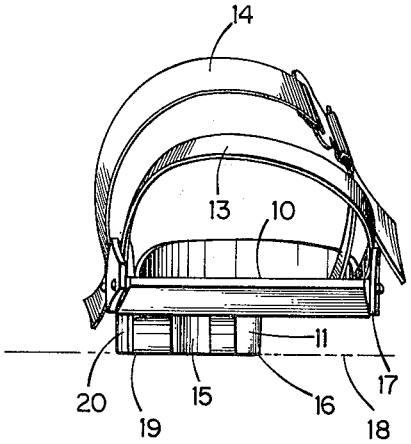
FIG. 5 is a front elevation view of the device shown in FIG. 1.
Figure 4:
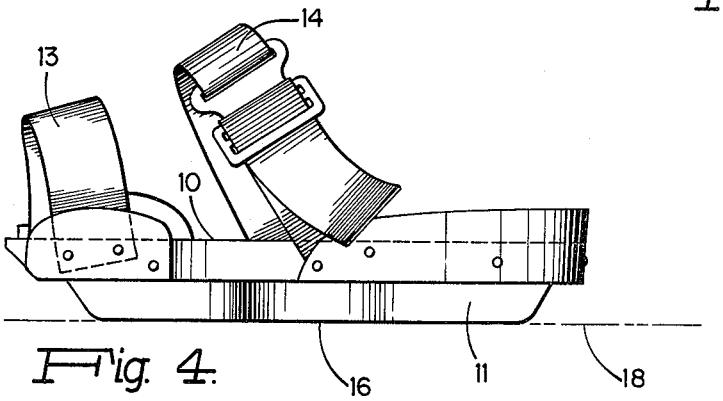
FIG. 4 is a left hand side elevation view of FIG. 1.
Figure 6:
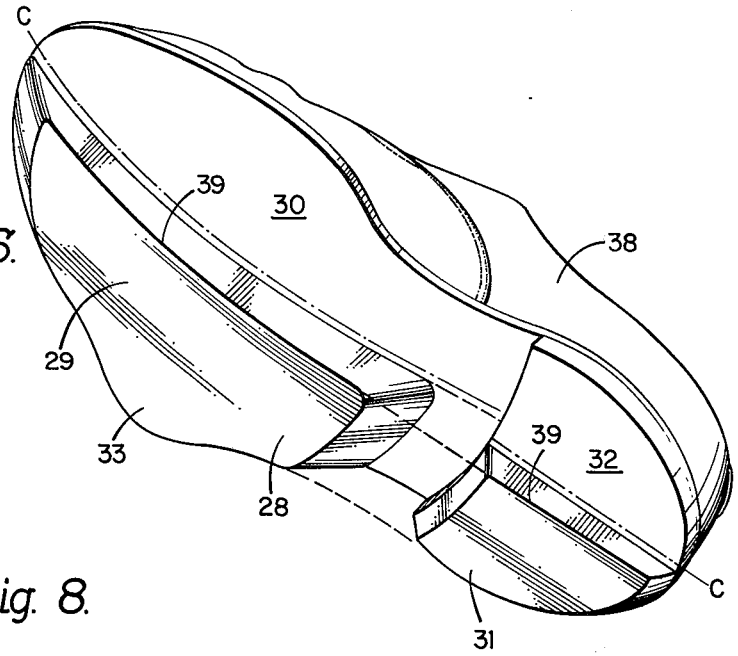
FIG. 6 shows a modification in perspective in which the device of the invention is made in two parts and permanently attached to the sole and heel of the user's shoe.
Figure 8:
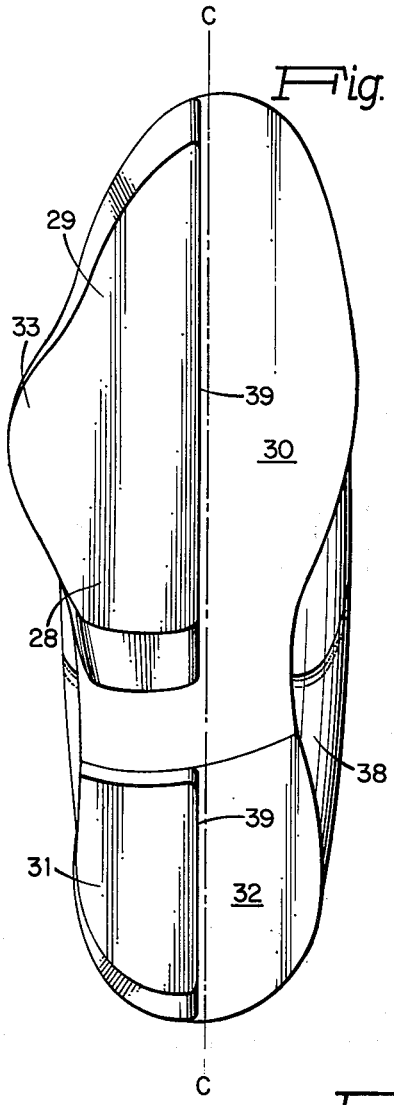
FIG. 8 is a bottom plan view of FIGS. 6 and 7.
Figure 9:
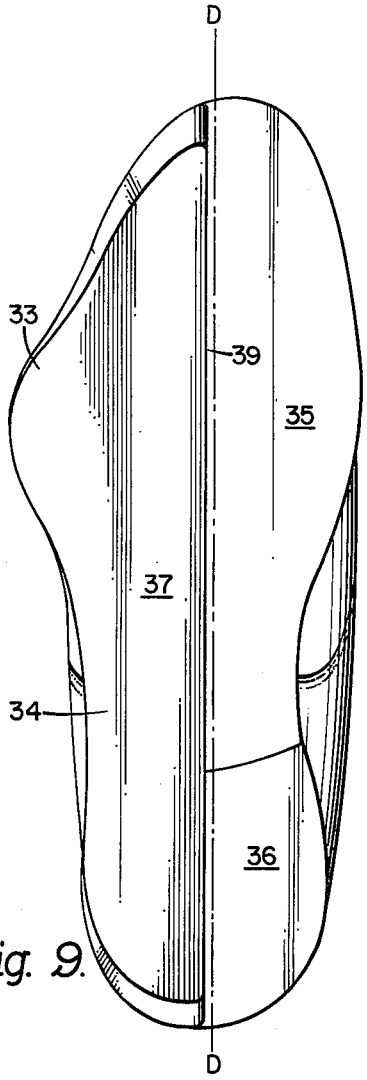
FIG. 9 is a bottom plan view of another modification in which the device is in the form of a single unit permanently attached to the sole of the user's shoe.

As can be seen in the drawings, the balance bar 11 in FIGS. 1 to 5, 28 in FIGS. 6 and 8 and 34 in FIG. 9, is off-centered to the outside of the longitudinal axis. In an unsupported position, and with the balance bar in contact with the floor, the top surface on which the user's foot is pressing is tilted or canted inwardly, as indicated by the dotted line position in FIG. 7, so that it approximates the plane of the undersurface of the foot in pronation. Thus, when the device is securely attached to a user's foot, the only way the top and bottom surfaces of the device can be brought to a laterally level or horizontal plane is by inverting the arch to force the weight to the outer margin of the foot and this can only be accomplished by muscular effort with the use of the inverters.

Referring now with greater particularity to the drawings, there is shown in FIGS. 1–5 one form of anti-pronation device or clog for attachment to each shoe or foot of a wearer. This clog is generally comprised of a rigid base 10 with an irregularly shaped balance bar or runner 11 on one side of the underportion thereof. Since this clog is worn on either the foot directly or, alternatively, over the shoe, there is both a vamp strap 13 over the vamp area and an instep strap 14 over the instep area below the ankle joint. These strap members may be made of an elastic material or other suitable strapping having an adjustable strap and buckle arrangement.

Figure 1:
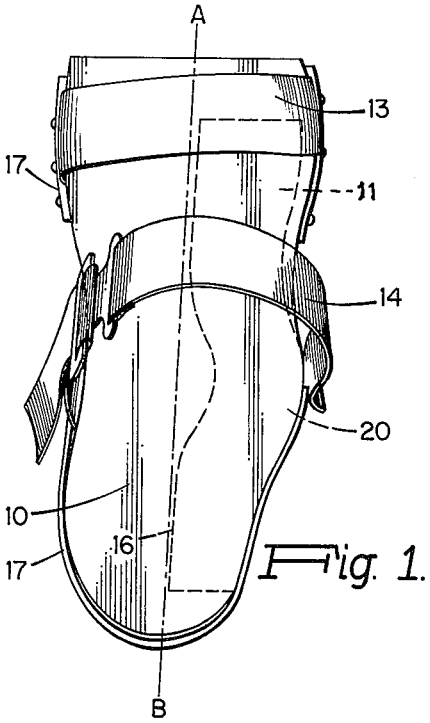
FIG. 1 is a top plan view of one form of my anti-pronation exerciser which is removably attached to the user's shoe.
Figure 2:
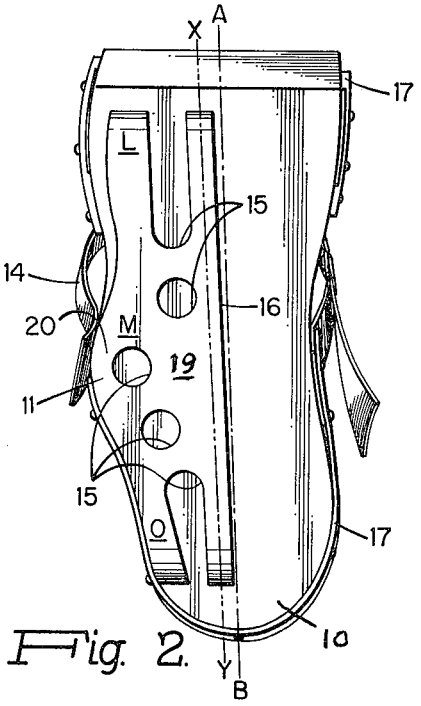
FIG. 2 is a botton plan view of FIG. 1.
Figure 3:
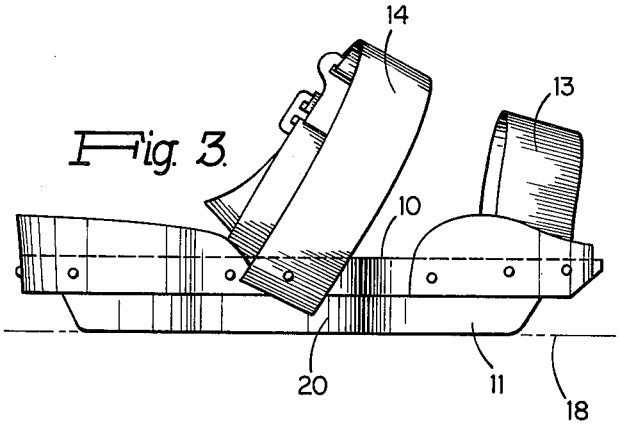
FIG. 3 is a right hand side elevation view of the anti-pronation device shown in FIG. 1.

Balance bar 11 of suitable length and width in relation to base 10 is located on the outer side of line A–B of FIGS. 1 and 2 extending from the heel area (or from a variable point forward of the back of the heel), to some point in the general area of the metatarsal heads or ball area of the foot. In the preferred embodiment, the balance bar 11 will be approximately ⅝ inch thick but may vary with the overall size of the device.

It will be appreciated that the unit shown in FIGS. 1 to 5 is designed for attachment to the user's right foot. A similar complementary unit is available for attachment to the left foot, but the following description will apply to the right foot unit only, it being understood that the left foot unit will behave in the same manner but in the reverse direction.

When the user is standing on the unit 10 as viewed in FIG. 5 and is making no effort to hold his ankle in proper position, the unit will rotate about the edge 16 until the inner edge 17 of base 10 touches the floor at the point 18. In this position, the user's ankle is pronated substantially outwardly and the foot is in a position approximating the so-called flat-foot condition.

In order to bring the shoe and foot back to correct horizontal position, the user must make a conscious physical effort to rotate his foot inwardly. In so doing the base will be rotated counterclockwise as viewed in FIG. 5 about edge 16. Rotation will, of course, stop as soon as the bottom surface 19 of the balance bar engages the floor. In order to hold the base and balance bar in this horizontal position as the user stands thereon, a continuous force must be exerted by the muscles controlling this inward rotation of the foot. It is this muscular effort repeated at intervals during the day and for a short period of weeks thereafter that will strengthen the pertinent ankle and leg muscles sufficiently to overcome the flat-foot condition and to enable the person thereafter to walk properly on the outside of his foot.

In order to prevent the user from going beyond the proper horizontal position as he rotates his foot inwardly, the balance bar 11 has a lateral projection 20 extending a substantial distance outwardly beyond the outer side of the user's foot. This acts as a lever to block further counterclockwise rotation of the balance bar as viewed in FIG. 5 beyond the horizontal. Then the user knows when his ankles and feet are in correct position both when standing still or walking on the balance bars which are then carrying his full weight.

The illustrated embodiment in FIG. 2 shows a slightly modified balance bar 11 having the same exterior configuration, differing only in that it is perforated or recessed with cut-outs 15 for weight saving reasons, and also for providing better contact with rug type floor coverings whereby the rug nap enters these cut-outs and thus tends to prevent slipping. The remaining surface area indicated at L, M and O is adequate for support. It is, of course, to be understood that the entire floor contacting surface of balance bar 11 may be covered with a skid-resistant coating. Balance bar 11 may be removably connected to base 10, or, alternatively, the entire combination may be manufactured as an integral unit. It is to be further understood that in lieu of the balance bar, other means may be employed to provide the unbalance contemplated by this disclosure, as, for example, a plurality of small pegs or other protuberances may be attached to the under portion of base 10, or suitably attached to the sole portion of a wearer's shoes for that matter.

Modifications of the invention are shown in FIGS. 6, 7, 8 and 9. These constructions are the same in principle as those shown in FIGS. 1 to 5, differing only in that the balance bars are permanently secured to the user's shoes. This is often of economic advantage with children as the balance bars may be attached by nailing or gluing to a worn pair of shoes about to be discarded. Since the required muscular training period is usually not more than a few weeks at most, the child will ordinarily not outgrow the shoes before he has overcome his flat-foot condition. If necessary, the balance bars can be detached and used again on other shoes.

In FIGS. 6 and 8, the balance bar 28 is made in two pieces, one piece 29 being under the shoe sole 30 and the other piece 31 being under the heel 32. Both pieces are attached outward of the line C—C that defines the approximate center line of the foot.

The balance bar 29 has a lateral extension 33 similar to extension 20 shown in FIGS. 1, 2 and 5, for preventing outward rollover beyond the horizontal.

In order to provide a correct walking surface, the sole piece 29 is thicker than the heel piece 31.

In the construction shown in FIG. 9, the balance bar 34 is made of a single piece of material and preferably shaped to fit against the shoe sole 35 and heel 36 in a manner to provide a proper continuous walking bottom surface 37.

The balance bar 34 is located to the outside of the approximate center line D—D of the foot. The behavior of this construction with respect to pronation of the foot and ankle is the same as that found in FIGS. 1 to 5 and FIGS. 6 and 8.

Figure 7:
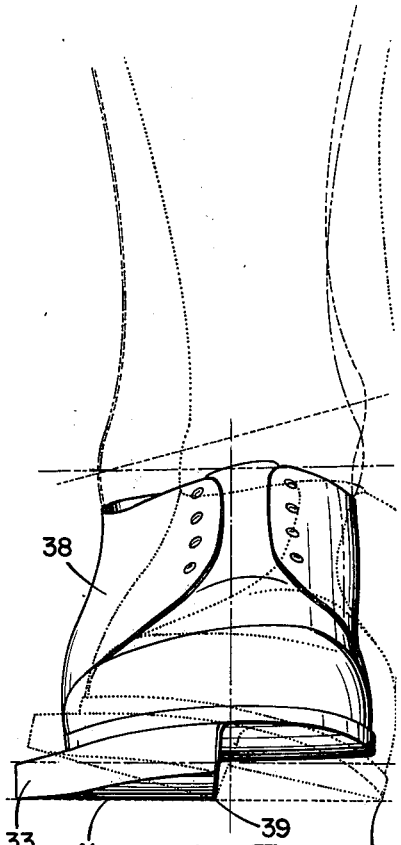
FIG. 7 is a front elevation of the construction shown in FIG. 6 with the shoe being maintained in horizontal position by use of the foot, ankle and leg muscles.

The front elevation view in FIG. 7 is illustrative in the dotted line position of the manner in which the foot rolls outward when the user stands on the balance bar without using his ankle muscles. The shoe 38 is being supported on the balance bar edge 39 and the inner edge 40 of the shoe sole. The solid line position is that which results when the user by muscular effort rotates the balance bar about edge 39 to bring the bottom 41 of the balance bar against the floor. The lateral extension 33 prevents outward rollover.

It should now be apparent in light of the foregoing description that I have provided a foot-attached exercising device which is useful in overcoming problems relating to pronation, i.e., weak arches and resulting flat feet.

The particular embodiments of the invention herein chosen for illustration and description are exemplary only, and it will, accordingly, be understood that various changes in the details, materials, and arrangements of parts herein described and illustrated may be made by those skilled in the art within the principles and scope of the invention as expressed in the appended claims.

I claim:

1. An anti-pronation exercising device adapted to be secured to a user's foot, said device comprising a base portion adapted to lie generally coextensive laterally with the width of the user's foot and coextensive longitudinally from the heel to at least the ball of the user's foot and having upper and lower surfaces;

a balance bar mounted on the said lower surface of said base portion and positioned to the outside of the centered longitudinal axis of the said base portion;

the said balance bar having a bottom weight supporting surface which has a longitudinally extending inner edge substantially aligned with said longitudinal axis and about which edge said device may pivot as the user's foot is pronated while standing thereon;

and means for attaching said device firmly in relation to the sole of the user's foot.

2. The construction set forth in claim 1, said balance bar having a plurality of recesses adapted to receive and accommodate portions of a resilient surface which said user may be walking on.

3. The construction set forth in claim 1, said balance bar having a weight bearing portion thereof extending laterally beyond the outside front to rear boundary of the user's foot, whereby the ability of the user to rotate his foot inwardly beyond the horizontal when standing on said balance bar will be substantially diminished.

4. The construction set forth in claim 1, said base portion being in the form of a rigid pad adapted to fit against and be secured to the sole of the user's shoe.

5. The construction set forth in claim 1, said base portion comprising part of a shoe of a size adapted to fit the user's foot.

6. The construction set forth in claim 5, said balance bar being formed in a single unit attached to the sole and heel of said shoe.

7. The construction set forth in claim 5, said balance bar being formed of two pieces, one piece attached to the sole and the other piece attached to the heel of said shoe, the inner edges of said pieces being substantially longitudinally aligned and the bottom surfaces of said pieces being substantially aligned to form a walking surface.

8. A foot-attached antipronation exercising device comprising a rigid base portion adapted to lie generally laterally coextensive with a wearer's foot and having an upper and a lower surface;

balance bar means depending from the outer half of said lower surface in substantially parallel relation to the base portion and positioned to the outside of the centered longitudinal axis of the base portion;

means for attaching the said base portion to a wearer's foot;

said balance bar means that depends from said lower surface comprising a member having a lateral width commencing essentially from approximately the centered longitudinal axis of the base portion to the outer edge of said base, and a length generally coextensive with the length of said base.

* * * * *